US009254945B2

(12) United States Patent
McClung et al.

(10) Patent No.: US 9,254,945 B2
(45) Date of Patent: Feb. 9, 2016

(54) EASY POUR SPOUT

(71) Applicant: STOLLE MACHINERY COMPANY, LLC, Centennial, CO (US)

(72) Inventors: James A. McClung, Canton, OH (US); Aaron E. Carstens, Centerville, OH (US); Jason A. Davidson, Sidney, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 14 days.

(21) Appl. No.: 13/973,455

(22) Filed: Aug. 22, 2013

(65) Prior Publication Data

US 2014/0054332 A1 Feb. 27, 2014

Related U.S. Application Data

(60) Provisional application No. 61/692,743, filed on Aug. 24, 2012.

(51) Int. Cl.
*B65D 47/10* (2006.01)
*B65D 17/00* (2006.01)

(52) U.S. Cl.
CPC ..... *B65D 47/106* (2013.01); *B65D 17/165* (2013.01); *B65D 2517/0014* (2013.01); *B65D 2517/0062* (2013.01); *B65D 2517/0089* (2013.01)

(58) Field of Classification Search
CPC .. B65D 17/163; B65D 17/165; B65D 47/106; B65D 2517/0014; B65D 2517/0062; B65D 2517/0089
USPC ..... 222/541.9, 575; 220/272, 273, 270; D9/438, 763, 518
See application file for complete search history.

(56) References Cited

U.S. PATENT DOCUMENTS

| | | | | | |
|---|---|---|---|---|---|
| 3,967,752 | A | * | 7/1976 | Cudzik | 220/269 |
| 4,061,243 | A | * | 12/1977 | Khoury | 220/269 |
| 4,205,760 | A | * | 6/1980 | Hasegawa | 220/271 |
| 4,289,251 | A | * | 9/1981 | Maliszewski | 220/269 |
| 4,399,925 | A | * | 8/1983 | Fundom | 220/269 |
| 5,011,037 | A | | 4/1991 | Moen et al. | |
| D338,156 | S | * | 8/1993 | Cook | D9/438 |
| 5,415,313 | A | * | 5/1995 | Sang-Seo | 220/269 |
| 5,683,006 | A | * | 11/1997 | Cook, III | 220/269 |

(Continued)

FOREIGN PATENT DOCUMENTS

EP 2 038 178 B1 10/2010

OTHER PUBLICATIONS

International Searching Authority, International Search Report and Written Opinion for International Application No. PCT/US2013/056144, issued Jan. 17, 2014.

*Primary Examiner* — Lien Ngo
(74) *Attorney, Agent, or Firm* — Eckert Seamans Cherin & Mellott, LLC; Grant E. Coffield; John P. Powers

(57) ABSTRACT

A can end is provided, which includes a center panel having a radius, a tab fastened to the center panel, and a scoreline defining a tear panel in the end panel. The tab is operable to sever the scoreline and open the tear panel to provide an opening in the can end. The tear panel includes an enlarged portion extending outwardly toward the center panel radius, thereby enlarging the opening. The enlarged portion forms an easy pour spout.

13 Claims, 7 Drawing Sheets

(56) References Cited

U.S. PATENT DOCUMENTS

| | | | | |
|---|---|---|---|---|
| 5,711,448 | A * | 1/1998 | Clarke, III | 220/269 |
| 5,934,498 | A * | 8/1999 | Jordan | 220/270 |
| 5,964,366 | A | 10/1999 | Hurst et al. | |
| 6,164,480 | A * | 12/2000 | Heinicke et al. | 220/269 |
| 6,234,336 | B1 * | 5/2001 | Neiner | 220/269 |
| 6,405,889 | B1 * | 6/2002 | Neiner | 220/269 |
| 6,761,281 | B2 * | 7/2004 | Hartman | 220/269 |
| 6,793,087 | B2 * | 9/2004 | Dyren | 220/254.4 |
| D570,228 | S * | 6/2008 | van Dam | D9/772 |
| D600,116 | S * | 9/2009 | Cherian | D9/438 |
| 7,594,585 | B1 * | 9/2009 | Fields | 220/269 |
| D612,724 | S * | 3/2010 | Cherian | D9/438 |
| D612,747 | S * | 3/2010 | Ball | D9/772 |
| 7,748,563 | B2 * | 7/2010 | Turner et al. | 220/623 |
| 7,975,884 | B2 * | 7/2011 | Mathabel et al. | 222/541.9 |
| D653,125 | S * | 1/2012 | Murphy | D9/776 |
| 8,998,028 | B2 * | 4/2015 | Ramsey et al. | 220/703 |
| 2004/0195240 | A1 * | 10/2004 | Brandon | 220/269 |
| 2007/0039961 | A1 * | 2/2007 | McEldowney et al. | 220/269 |
| 2008/0011786 | A1 | 1/2008 | Mathabel et al. | |
| 2008/0197618 | A1 * | 8/2008 | Ronnberg | 283/67 |
| 2009/0200306 | A1 * | 8/2009 | Breunig | 220/270 |
| 2010/0025402 | A1 * | 2/2010 | Hoffman et al. | 220/270 |
| 2010/0258562 | A1 | 10/2010 | Linden et al. | |
| 2010/0294771 | A1 * | 11/2010 | Holder et al. | 220/271 |
| 2013/0037542 | A1 * | 2/2013 | Crothers | 220/269 |
| 2013/0126529 | A1 * | 5/2013 | Nesling et al. | 220/271 |

* cited by examiner

EASY POUR SPOUT

CROSS-REFERENCE TO RELATED APPLICATION

This patent application claims the priority benefit wider 35 U.S.C. §119(e) of U.S. Provisional Application No. 61/692,743 filed on Aug. 24, 2012, and entitled, "EASY POUR SPOUT," the contents of which are hereby incorporated herein by reference.

BACKGROUND

1. Field

The disclosed concept relates generally to containers and, more particularly, to can ends for containers, such as beer and beverage cans. The disclosed concept also relates to an easy pour spout for can ends.

2. Background Information

Metallic containers (e.g., cans) for holding products such as, for example, liquids, beverages, or food products, are typically provided with an easy open can end on which an opening mechanism, such as a pull tab, is attached (e.g., without limitation, riveted) to a tear strip or severable panel. Typically, the tear strip is defined by a scoreline in the exterior surface (e.g., public side) of the can end. The pull tab, commonly referred to simply as the "tab," is structured to be lifted, pulled, and/or rotated to sever the scoreline and deflect the tear strip, thereby creating an opening for dispensing the contents of the can.

When the can end is made, it originates as a can end shell, which is formed from a sheet metal product (e.g., without limitation, sheet aluminum; sheet steel). The shell is then conveyed to a conversion press, which has a number of successive tool stations. As the shell advances from one tool station to the next, conversion operations such as, for example and without limitation, rivet forming, paneling, scoring, embossing, tab securing and tab staking, are performed until the shell is fully converted into the desired can end and is discharged from the press. Typically, each tool station of the conversion press includes an upper tool member, which is structured to be advanced towards a lower tool member upon actuation of a press ram. The shell is received between the upper and lower tool members. Thus, as the upper tool member engages the shell, the upper and/or lower tool members respectively act upon the public and/or product (e.g., interior side, which faces the can body) sides of the shell, in order to perform a number of the aforementioned conversion operations. Upon completion of a given operation, the press ram retracts the upper tool member and the partially converted shell is moved to the next successive tool station, or the tooling is changed within the same station, to perform the next conversion operation.

In the canmaking industry, there is an ongoing desire to improve the rate and manner in which the contents of the container are dispensed. With respect to beverage cans, the can end design can significantly impact the pour characteristics of the can. The opening of a conventional large open end (LOE), for example, is generally not large enough to allow sufficient air to displace the liquid volume, and subsequent vacuum, as the liquid is poured from the container. That is, as the liquid leaves the container, air is entrained through the primary pour opening causing a pressure differential between the interior and exterior of the can, thereby forming the aforementioned vacuum behind the liquid. This, in turn, creates fluid turbulence and interrupted or discontinuous flow. As a result, "glugging" and/or splashing, a slower than desired pour or flow rate, and/or excessive carbonation or foaming of the dispensed liquid, can occur.

Prior proposals for addressing these issues employ a plurality of additional openings or other mechanisms or can end features in an attempt to vent the can end. Among other disadvantages, such can end designs are relatively complex and costly and/or require an additional separate tool (e.g., without limitation, church key; bottle opener; screw driver) or object (e.g., without limitation, key), and/or require a plurality of opening operations.

There is, therefore, room for improvement in can ends for containers, such as beer and beverage cans, and in openings therefor.

SUMMARY

These needs and others are met by embodiments of the disclosed concepts, which are directed to an easy pour spout for containers, such as for example, beer and beverage cans.

As one aspect of the disclosed concept, a can end comprises: a center panel having a radius; a tab fastened to the center panel; and a scoreline defining a tear panel in the end panel; the tab being operable to sever the scoreline and open the tear panel to provide an opening in the can end. The tear panel includes an enlarged portion extending outwardly toward the center panel radius, thereby enlarging the opening.

The enlarged portion may form an easy pour spout. The easy pour spout may be disposed at or about the outer edge of the opening and substantially in the center of the opening.

The enlarged portion may comprise an arcuate extension portion extending toward the center panel radius by a predetermined distance.

The center panel may include a rivet, wherein the tab is fastened to the center panel by the rivet. The rivet may be offset with respect to the center of the can end when viewed from a top plan perspective.

As another aspect of the disclosed concept, a container is provided which employs the aforementioned can end.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
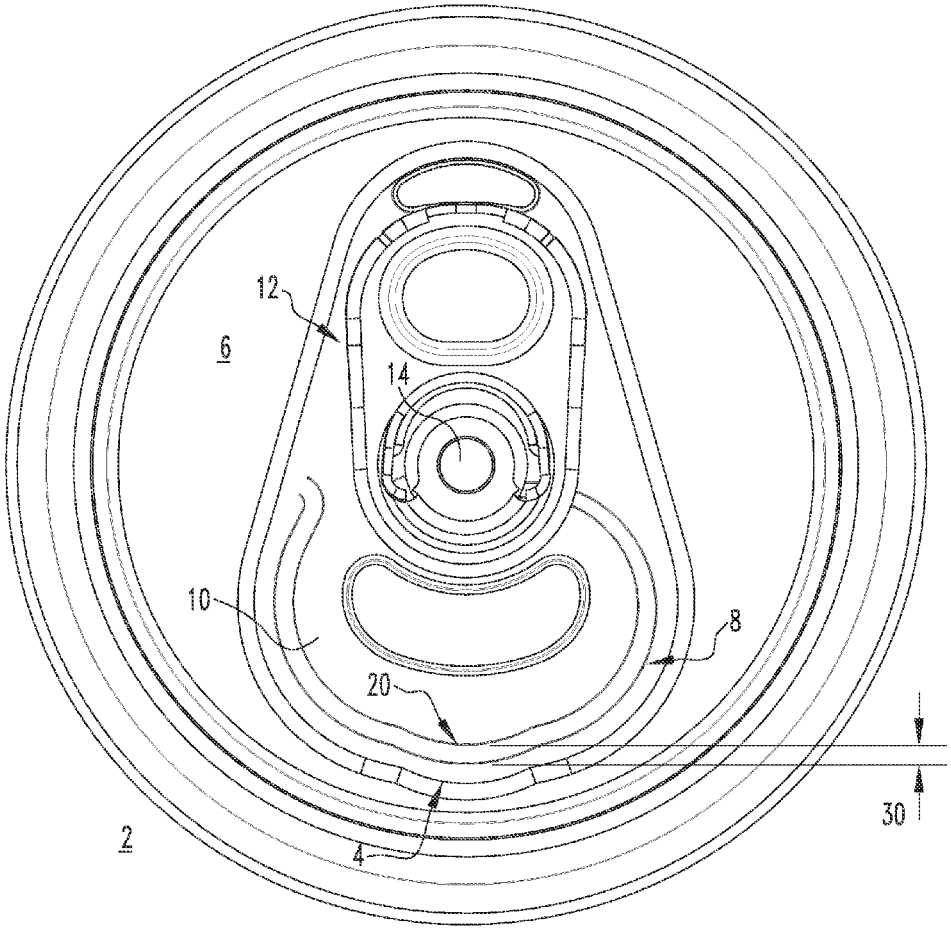
FIG. 1 is a top plan view of a can end including an easy pour spout, in accordance with an embodiment of the disclosed concept.

For purposes of illustration, embodiments of the disclosed concept will be described as applied to can ends for beverage/beer cans, although it will become apparent that they could also be employed to other contains such as, for example and without limitation, cans for liquids other than beer and beverages, and food cans.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations and other physical characteristics related to the embodiments disclosed herein are not to be considered limiting on the scope of the disclosed concept.

Directional phrases used herein, such as, for example, clockwise, counterclockwise, left, right, front, back, top, bottom, upper, lower and derivatives thereof, relate to the orientation of the elements shown in the drawings and are not limiting upon the claims unless expressly recited therein.

As employed herein, the terms "can" and "container" are used substantially interchangeably to refer to any known or suitable container, which is structured to contain a substance (e.g., without limitation, liquid; food; any other suitable substance), and expressly includes, but is not limited to, food cans, as well as beverage cans, such as beer and soda cans.

As employed herein, the term "can end" refers to the lid or closure that is structured to be coupled to a can, in order to seal the can.

As employed herein, the term "can end shell" is used substantially interchangeably with the term "can end." The "can end shell" or simply the "shell" is the member that is acted upon and is converted by the disclosed tooling to provide the desired can end.

As employed herein, the term "center panel radius" refers to the radius of the curved or rounded portion at the periphery of the center panel.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows a can end 2 including an easy pour spout 4, in accordance with one non-limiting embodiment of the disclosed concept. The can end 2 includes an end panel or center panel 6 and a scoreline 8, which defines a tear panel 10 in the center panel 6. A tab 12 is fastened to the can end 2, for example and without limitation, by a rivet 14, and is structured to be actuated (e.g., without limitation, lifted and pivoted) to sever the scoreline 8 about the tear panel 10, and depress the tear panel 10 downward (FIG. 1A), thereby providing an opening 16 (see, for example, primary pour opening 16 partially shown in FIG. 1A) in the can end 2 for dispensing the contents of the container or can 500 (partially shown in simplified form in phantom line drawing in FIG. 1A) to which the can end 2 is affixed. However, unlike the primary pour openings (not shown) of convention can end designs, the disclosed opening 16 includes an enlarged portion forming the aforementioned easy pour spout 4. Specifically, as will be discussed in greater detail herein, the tear panel 10 includes an enlarged portion 20 that extends outwardly toward the center panel radius (see, for example, center panel radius 240 of FIG. 4), thereby enlarging the pour opening 16. Thus, the disclosed concept advantageously provides a larger opening aperture to address known pouring issues such as "glugging" and inconsistent and/or interrupted pouring or flow rate. Specifically, it has been discovered that the location of the enlarged portion 20 of the disclosed pour spout 4 (see also, without limitation, pour spouts 104,204,304,404 and 504 in FIGS. 2,3,5,6 and 7, respectively) allows the pour opening area to be further increased, without making a significant impact on opening forces, characteristics and/or performance.

Continuing to refer to FIG. 1, the easy pour spout 4 of the example can end is preferably disposed at or about the 6 o'clock position (e.g., without limitation, the bottom center from the top plan view perspective of FIG. 1) of the can end opening 16. In other words, the opening 16 includes an outer edge (e.g., edge disposed closest to the outer perimeter of the can end). The spout 4 is preferably located in the center of this outer edge, as shown. In addition to enlarging the opening 16, the spout 4 also advantageously allows the fluid to exit closer to the center panel radius (i.e., closer to the edge of the can end 2). This, in turn, allows for a larger opening area (e.g., gap or space) near the 12 o'clock position e.g., top center of the opening 16 from the top plan view perspective of FIG. 1), near the rivet 14. More specifically, more open space is provided in this area to more freely entrain air as the fluid exits the pour opening 16. In this manner, the easy pour spout 4 also serves to help relieve the back pressure and vacuum known to form behind the fluid leaving the container 500 (FIG. 1A).

Accordingly, the disclosed easy pour spout 4 enlarges only a portion of the opening 16 and consequently offers a number of advantages over prior proposals that simply attempted to make the primary pour opening larger all the way around. Among other problems, such designs put undue stress on the tab and can result in higher opening forces and opening failures. The easy pour spout 4, on the other hand, allows for a larger opening area of the pour opening 16 while still maintaining opening characteristics that the consumer is accustomed to with the standard LOE design.

Figure 1A:
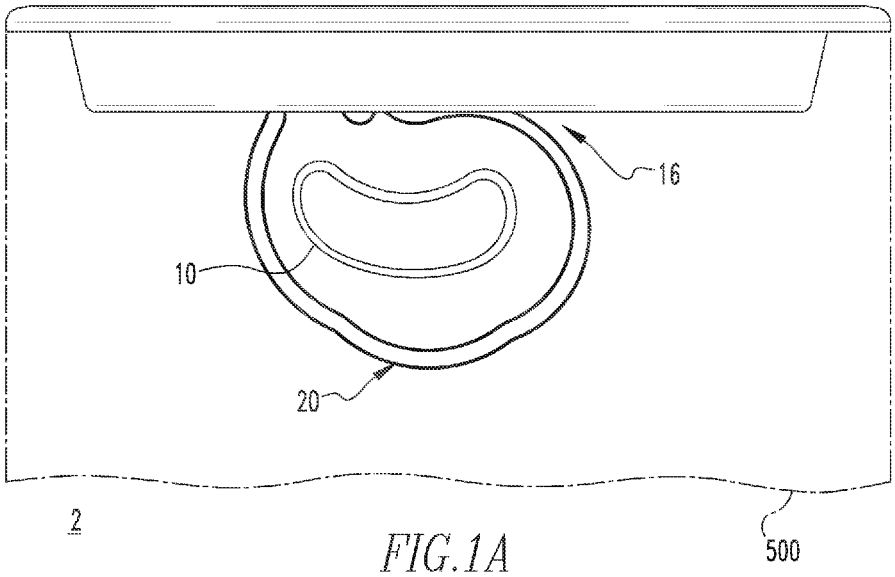
FIG. 1A is a side elevation view of the can end of FIG. 1, showing the can end after the tear panel has been opened.

As previously discussed, in the non-limiting example embodiment of FIGS. 1 and 1A, the easy pour spout 4 is formed by extending (i.e., enlarging) the pour opening 16 and, in particular the tear panel 10, at approximately the 6 o'clock position (e.g., without limitation, the bottom center from the top plan view perspective of FIG. 1) by a distance 30. More specifically, an additional enlarged portion 20 is added, which is preferably arcuate in shape and extends outwardly toward the periphery of the can end 2 (e.g., toward the center panel radius) by the additional distance 30, compared to conventional pour openings (not shown), which do not include any such extension or enlarged spout portion. In the example of FIGS. 1 and 1A, the enlarged portion 20 (e.g., extension) extends a distance 30 of about 0.035 inches. However, it will be appreciated that the easy pour spout 4 could have any known or suitable alternative size, shape, position and/or configuration, without departing from the scope of the disclosed concept.

Figure 2:
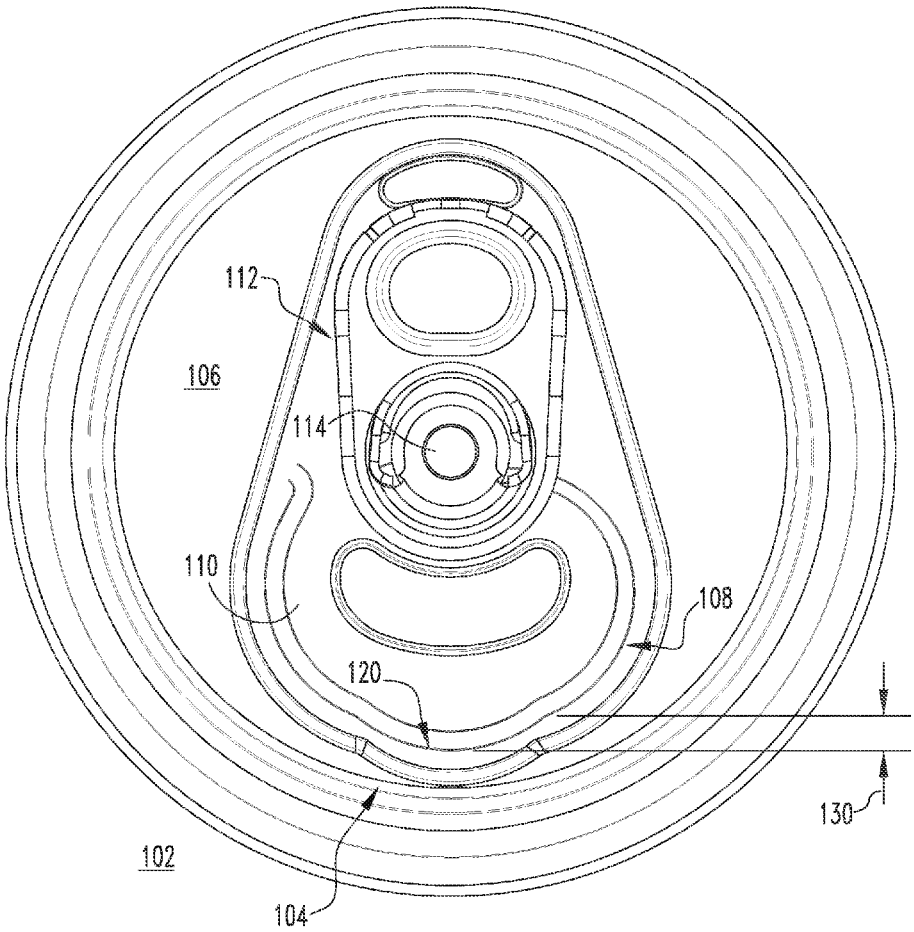
FIG. 2 is a top plan view of the can end including an easy pour spout, in accordance with another embodiment of the disclosed concept.
Figure 3:
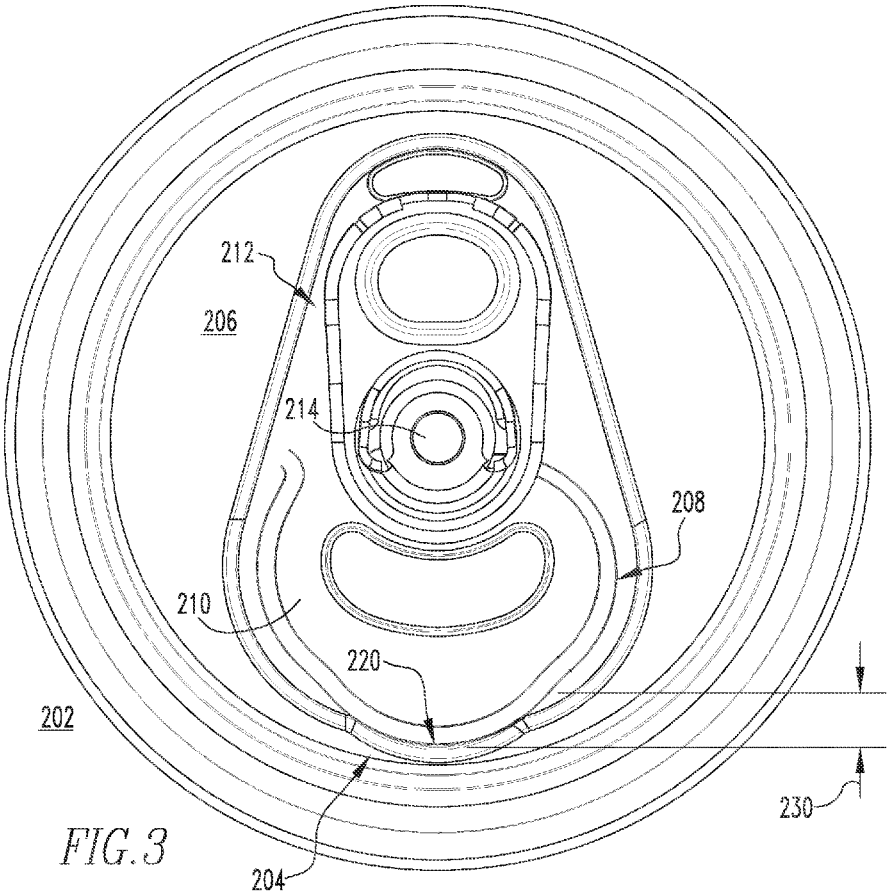
FIG. 3 is a top plan view of the can end including an easy pour spout, in accordance with another embodiment of the disclosed concept.

For example and without limitation, FIG. 2 shows another non-limiting example of a can end 102 having an easy pour spout 104, in accordance with another embodiment of the disclosed concept, wherein the pour opening 116 has an arcuate enlarged portion 120 that preferably extends outwardly a distance 130 of about 0.070 inches at the 6 o'clock position (e.g., from the top plan perspective of FIG. 2), as shown. It will be appreciated that, for reference, the rivet 114 is disposed at the 12 o'clock position (e.g., from the top plan perspective of FIG. 2). The can end 102, like can end 2, described previously hereinabove, may include any known or suitable tab 112, and a scoreline 108 that defines the tear panel 110 in the end panel 106. FIG. 3 shows another non-limiting example of a can end 202 having an easy pour spout 204, in accordance with another embodiment of the disclosed concept. In the example of FIG. 3, the end panel 206 includes a scoreline 208 defining a tear panel 210 and associated pour opening 216 that has an enlarged portion 220 that preferably extends a distance 230 of about 0.140 inches. The can end 202, like can ends 2,102, described previously hereinabove, may include any known or suitable tab 212 that is staked by a rivet 214, or otherwise suitably fastened, to the end panel 206.

Figure 4:
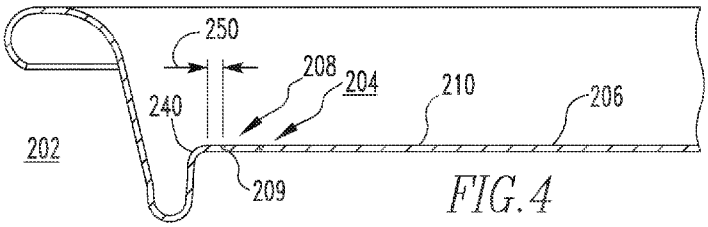
FIG. 4 is an enlarged side section view of a portion of the can end of FIG. 3.

As best shown in FIG. 4, it will be appreciated that the center panel radius 240 limits the size of the easy pour spout 204 (see also easy pour spouts 4 and 104 of FIGS. 1 and 2, respectively) and, in particular, the amount by which the scoreline 208 defining the tear panel 210 can be extended outwardly (i.e., toward the periphery of the center panel 206). For example and without limitation, in the embodiment of FIG. 3, wherein the distance 230 the enlarged portion 220 is extended is about 0.140 inches, the edge of the extended portion 220 is within a distance 250 from the tangency of the center panel radius 240. In the non-limiting example of FIGS. 3 and 4, this distance 250 is between 0.015-0.020 inches. It will, however, be appreciated that any known or suitable alternative distance from the tangency of the center panel radius 240 could be employed, without departing from the scope of the disclosed concept. For example and without limitation, it will be appreciated that the end panel (e.g., 206) could alternatively not have any de-boss or down panel at all at the 6 o'clock position (e.g., from the top plan perspective of FIG. 3).

In view of the foregoing, it will be appreciated that the increased area created by the disclosed easy pour spout 4,104,204 provides the necessary space for air to be entrained to help regulate (e.g., without limitation, equalize) the air pressure between the interior of the container (see, for example and without limitation, can 500 partially shown in simplified form in phantom line drawing in FIG. 1A) and the exterior of the container 500 (FIG. 1A). Consequently, disadvantages (e.g., without limitation, glugging; slow pour rate; intermittent pouring; splashing; excessive carbonation and foaming) of prior art designs are substantially addressed and overcome, and the pour characteristics of the can end 2,102,202 are improved. Testing of the disclosed concept has proven that significant reduction of glugging can occur depending on how much the primary pour opening is extended at the 6 o'clock position. A summary of test results is provided, for example and without limitation, in Table 1, below. Conventional ounce aluminum beverage cans were employed for the test.

TABLE 1

Time (sec.) to dispense can using alternative primary pour apertures extended at the 6 o'clock position.

| Control | LOE enlarged by 0.035" | LOE enlarged by 0.070" | LOE enlarged by 0.140" |
|---|---|---|---|
| 8.9 SEC. | 8.9 SEC. | 7.8 SEC. | 6.9 SEC. |
| 9.3 SEC. | 9.4 SEC. | 7.8 SEC. | 7.2 SEC. |
| 8.9 SEC. | 9.1 SEC. | 8.1 SEC. | 6.9 SEC. |
| 9.0 SEC. | 9.1 SEC. | 7.9 SEC. | 7.0 SEC. |

As shown in Table 1, the time it takes for fluid to be dispensed can be reduced by up to 2 seconds, or more, depending on the geometry selected. This is a significant improvement. As discussed hereinabove, among other benefits, the disclosed easy pour spout 4,104,204 creates space (e.g., airway passage) at the 12 o'clock position (e.g., near the rivet 14,114,214) that would normally be substantially covered or filled with fluid. In other words, unlike a traditional LOE, when fluid is poured from the disclosed can end 2,102,202 the fluid does not cover the entire pour aperture 16,116,216. This allows additional unencumbered air to entrain into the container 500 (FIG. 1A) that would normally be pulled through the fluid created by the vacuum when the fluid leaves container 500 (FIG. 1). Consequently, less glugging occurs, resulting in significant improvement of flow rate through the pour opening 16,116,216.

Figure 5:
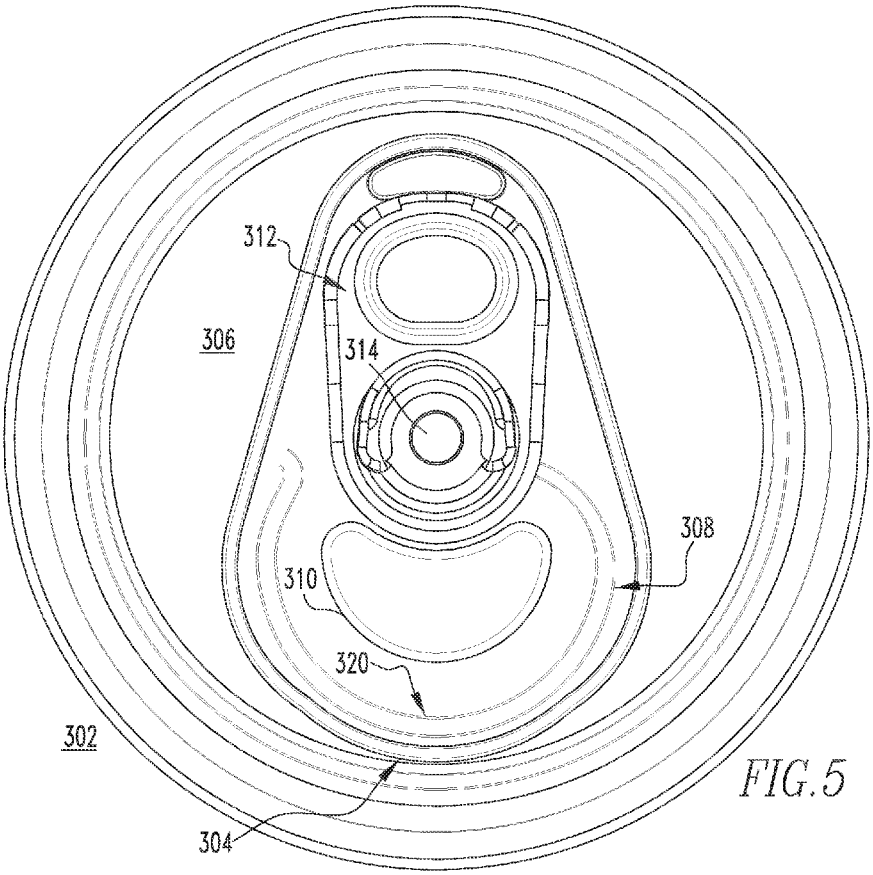
FIGS. 5 and 5A are top plan and side elevation views, respectively, of a can end and easy pour spout therefor, in accordance with another embodiment of the disclosed concept.
Figure 6:
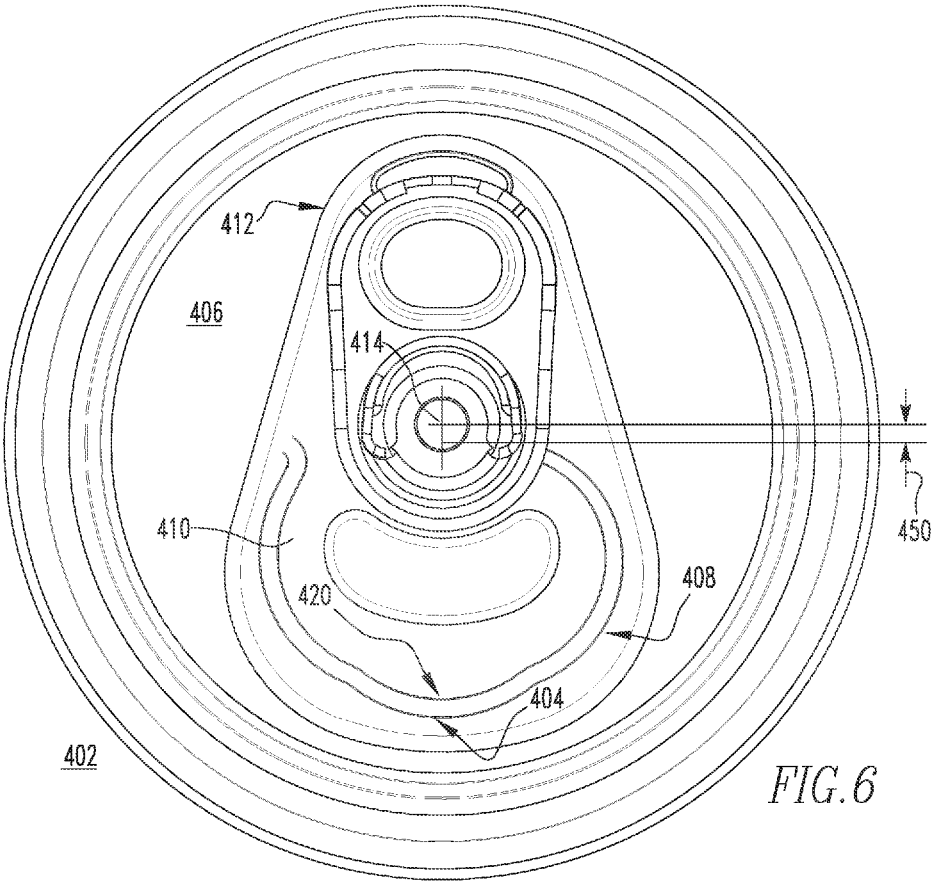
FIGS. 6 and 6A are top plan and side elevation views, respectively, of a can end and easy pour spout therefor, in accordance with another embodiment of the disclosed concept.
Figure 7:
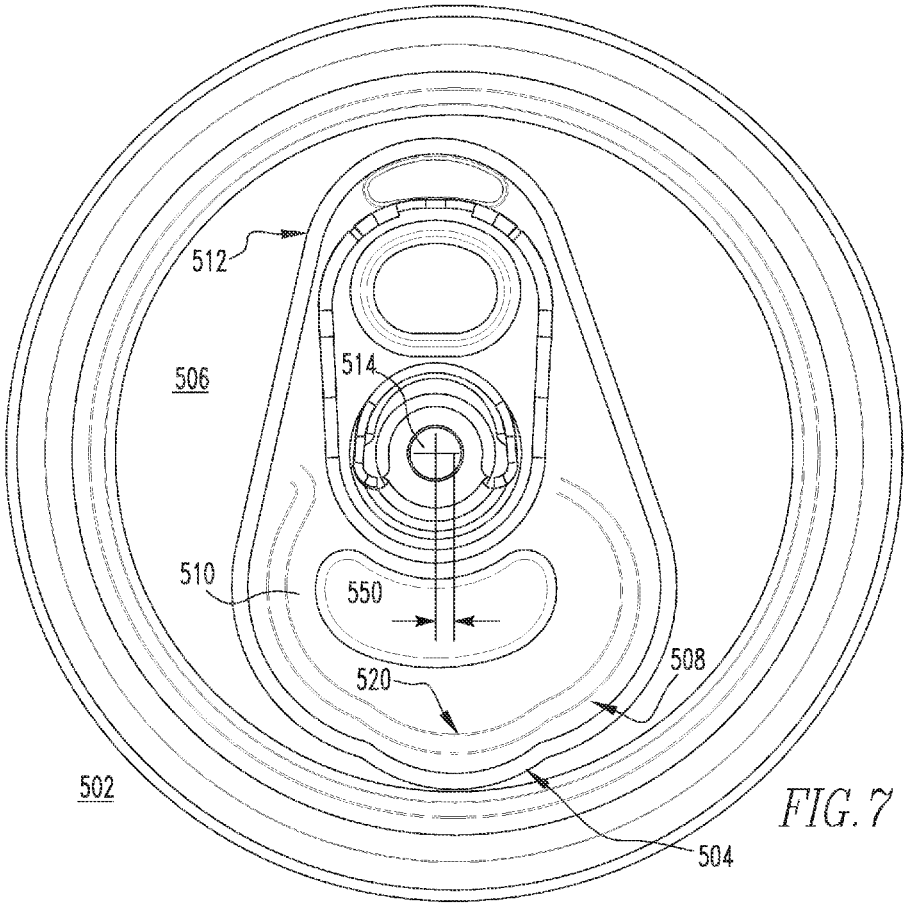
FIGS. 7 and 7A are top plan and side elevation views, respectively, of a can end and easy pour spout therefor, in accordance with another embodiment of the disclosed concept.

FIGS. 5, 6 and 7 respectively show additional, non-limiting alternative example embodiments of can ends 302,402,502 having easy pour spouts 304,404,504, in accordance with the disclosed concept.

Figure 5A:
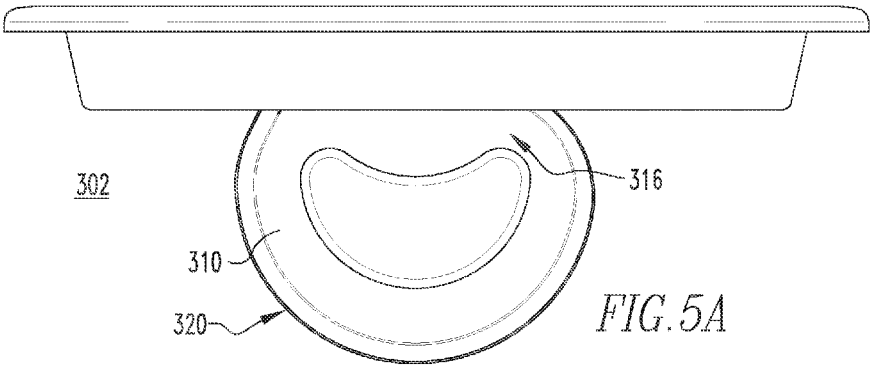

FIGS. 5 and 5A, for example and without limitation, show an embodiment in accordance with the disclosed concept wherein the can end 302 includes a center panel 306 with a scoreline 308 defining a tear panel 310, and a tab 312 fastened to the center panel 306 by a rivet 314. However, the pour spout 304 has a relatively less significant or pronounced change in shape from the aforementioned pour spout embodiments (e.g., 4,104,204). That is, the radius of curvature of the enlarged portion 320 of the tear panel 310 is generally the same as the radius of curvature of the remainder of the scoreline 308 and, therefore, the pour opening 316. Nonetheless, the easy pour spout 304 provides an enlarged portion 320 at or about the outermost portion of the tear panel 310 or corresponding opening 316, to enlarge the opening 316 at the 6 o'clock position (e.g., from the top plan perspective of FIG. 5).

Figure 6A:
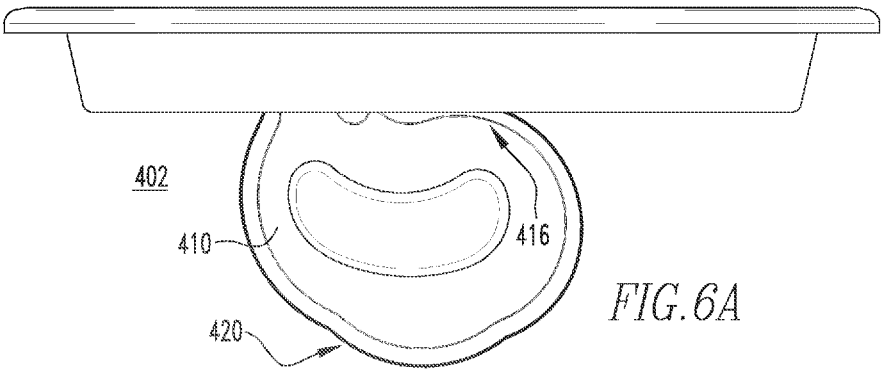

FIGS. 6 and 6A, for example and without limitation, show a different embodiment in accordance with the disclosed concept, wherein the can end 402 includes a center panel 406 with a scoreline 408 defining a tear panel 410, and a tab 412 fastened to the center panel 406 by a rivet 414. However, the rivet 414 and/or the pour spout 404 and corresponding enlarged portion 420 of the tear panel 410 is/are vertically offset (e.g., without limitation, shifted upward from the top plan perspective of FIG. 6) with respect to the center of the can end 402 (e.g., from the top plan perspective of FIG. 6), by a distance 450, as shown. The particular measurement of the offset distance, 450 is not intended to be a limiting aspect of the disclosed concept. It will also be appreciated that any such offset could alternatively be in another different direction (e.g., without limitation, downward; to the left; to the right (not shown)) or combination of directions (e.g., without limitation, upward and to the right; downward and to the right; upward and to the left; downward and to the left).

Figure 7A:
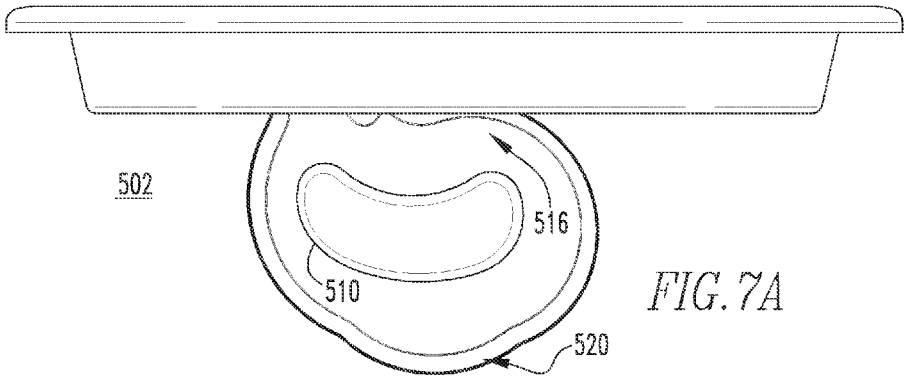

For example and without limitation, FIGS. 7 and 7A show a different embodiment in accordance with the disclosed concept, wherein the can end 502 includes a center panel 506 with a scoreline 508 defining a tear panel 510, and a tab 512 fastened to the center panel 506 by a rivet 514. However, the rivet 514 and/or the pour spout 504 and corresponding enlarged portion 520 of the tear panel 510 is/are laterally offset (e.g., without limitation, shifted to the right from the top plan perspective of FIG. 7) with respect to the center of the can end 502 (e.g., from the top plan perspective of FIG. 7), by a distance 550, as shown. The particular measurement of the offset distance 550 is not intended to be a limiting aspect of the disclosed concept.

A tooling assembly (not shown) for providing the aforementioned can end 2,102,202 and easy pour spout 4,104,204, respectively, therefor, generally includes a number of tooting stations each including a first toot member and a second tool member disposed opposite the first toot member. The first and second tool members are structured to cooperate in order to form the can end having the aforementioned features. It will also be appreciated that a number of tooling stations and tool members therefor are employed within a conversion press to convert shells into finished can ends (e.g., without limitation, can end 2,102,202) having the aforementioned pour spout 4,104,204 and other features, and the disclosed tab 12,112, 212, respectively, affixed thereto.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and ail equivalents thereof.

What is claimed is:

1. A can end comprising:

a center panel having a radius;

a tab fastened to the center panel; and a scoreline defining a tear panel in the center panel, the tab being operable to sever the scoreline and open the tear panel to provide an opening in the can end, wherein the tear panel includes an enlarged portion extending outwardly toward the center panel radius, thereby enlarging the opening to form an easy pour spout, wherein the easy pour spout is disposed at or about an outer edge of the opening and substantially in the center of the outer edge of the opening, wherein the enlarged portion comprises an arcuate extension portion having an edge, wherein the edge of the arcuate extension portion extends toward the center panel radius by a predetermined distance, wherein the outer edge of the opening is spaced apart from the center panel radius another predetermined distance, wherein the easy pour spout and the center panel are made of a single unitary piece of material, and wherein the tab is operable to pivot about a fixed location on the center panel in order to sever the scoreline and open the tear panel.

2. The can end of claim 1 wherein the predetermined distance the edge of the arcuate extension portion extends toward the center panel radius is between 0.02 inches and 0.15 inches.

3. The can end of claim 1 wherein the center panel includes a rivet; wherein the tab is fastened to the center panel by the rivet; and wherein the rivet is offset with respect to the center of the can end when viewed from a top plan perspective.

4. The can end of claim 3 wherein the rivet is vertically offset with respect to the center of the can end.

5. The can end of claim 3 wherein the rivet is laterally offset from the center of the can end, when the can end is viewed from the top plan perspective and the tab is disposed in its original, unactuated position extending longitudinally between the 12 o'clock position and the 6 o'clock position.

6. A container comprising:

a can body; and a can end seamed to the can body, said can end comprising:

a center panel having a radius, a tab fastened to the center panel, and a scoreline defining a tear panel in the center panel, the tab being operable to sever the scoreline and open the tear panel to provide an opening in the can end, wherein the tear panel includes an enlarged portion extending outwardly toward the center panel radius, thereby enlarging the opening to form an easy pour spout, wherein the easy pour spout is disposed at or about an outer edge of the opening and substantially in the center of the outer edge of the opening, wherein the enlarged portion comprises an arcuate extension portion having an edge, wherein the edge of the arcuate extension portion extends toward the center panel radius by a predetermined distance, wherein the outer edge of the opening is spaced apart from the center panel radius another predetermined distance, wherein the easy pour spout and the center panel are made of a single unitary piece of material, and wherein the tab is operable to pivot about a fixed location on the center panel in order to sever the scoreline and open the tear panel.

7. The container of claim 6 wherein the predetermined distance the edge of the arcuate extension portion extends toward the center panel radius is between 0.02 inches and 0.15 inches.

8. The container of claim 6 wherein the center panel includes a rivet; wherein the tab is fastened to the center panel by the rivet; and wherein the rivet is offset with respect to the center of the can end when viewed from a top plan perspective.

9. The container of claim 8 wherein the rivet is vertically offset with respect to the center of the can end.

10. The container of claim 8 wherein the rivet is laterally offset from the center of the can end, when the can end is viewed from the top plan perspective with the tab being disposed in its original, unactuated position extending longitudinally between the 12 o'clock position and the 6 o'clock position.

11. The container of claim 6, wherein the container is selected from the group consisting of beverage cans and food cans.

12. The can end of claim 1 wherein the predetermined distance the outer edge of the opening is spaced apart from the center panel radius is at least 0.015 inches.

13. The container of claim 6 wherein the predetermined distance the outer edge of the opening is spaced apart from the center panel radius is at least 0.015 inches.

* * * * *

UNITED STATES PATENT AND TRADEMARK OFFICE

CERTIFICATE OF CORRECTION

PATENT NO. : 9,254,945 B2
APPLICATION NO. : 13/973455
DATED : February 9, 2016
INVENTOR(S) : James A. McClung et al.

It is certified that error appears in the above-identified patent and that said Letters Patent is hereby corrected as shown below:

IN THE SPECIFICATION

Column 1, line 6, “wider” should read --under--.
Column 3, line 12, “contains” should read --containers--.
Column 6, line 48, “distance, 450” should read --distance 450--.

Signed and Sealed this
Thirty-first Day of May, 2016

Michelle K. Lee

Michelle K. Lee
*Director of the United States Patent and Trademark Office*